US007500804B2

(12) United States Patent
Nelson et al.

(10) Patent No.: US 7,500,804 B2
(45) Date of Patent: Mar. 10, 2009

(54) COMPACTION WHEEL SYSTEM AND METHOD

(75) Inventors: Jimmie P. Nelson, El Cajon, CA (US); Stephen D. Johnson, El Cajon, CA (US)

(73) Assignee: Cass Construction, Inc., El Cajon, CA (US)

( * ) Notice: Subject to any disclaimer, the term of this patent is extended or adjusted under 35 U.S.C. 154(b) by 71 days.

(21) Appl. No.: 11/407,890

(22) Filed: Apr. 21, 2006

(65) Prior Publication Data

US 2007/0248413 A1 Oct. 25, 2007

(51) Int. Cl.
*E01C 19/29* (2006.01)
*E01C 19/41* (2006.01)

(52) U.S. Cl. ..... 404/128; 404/132

(58) Field of Classification Search ..... 404/125–128, 404/132, 75, 71
See application file for complete search history.

(56) References Cited

U.S. PATENT DOCUMENTS 1,265,098 A * 5/1918 McKnight ..... 280/137.5
1,302,489 A * 4/1919 Hollis ..... 280/638
1,668,142 A * 5/1928 Conger ..... 219/244
2,146,101 A * 2/1939 Weber ..... 404/121
2,176,984 A * 10/1939 Adkinson ..... 172/548
2,197,395 A * 4/1940 Keeler ..... 404/127
2,287,723 A * 6/1942 Boyd et al. ..... 404/122
2,407,965 A * 9/1946 Smith ..... 404/122
2,466,822 A * 4/1949 Pollitz ..... 404/117
2,682,153 A * 6/1954 Fink, Sr. ..... 404/127
2,685,777 A * 8/1954 Plas ..... 404/127
2,777,709 A * 1/1957 Tucker ..... 280/104
2,943,541 A * 7/1960 Dunn et al. ..... 404/122
3,025,775 A * 3/1962 Grace ..... 404/122
3,060,818 A * 10/1962 Roberts ..... 404/122
3,146,686 A * 9/1964 Grace et al. ..... 404/127
3,899,037 A * 8/1975 Yuker ..... 180/6.48
4,109,747 A * 8/1978 Hornagold et al. ..... 180/414
4,149,253 A * 4/1979 Paar et al. ..... 701/50
4,278,368 A * 7/1981 Livesay ..... 404/117
4,342,263 A * 8/1982 Hurni ..... 104/7.2
4,610,567 A * 9/1986 Hosking ..... 404/121
4,911,248 A * 3/1990 Schrepfer ..... 172/464
4,927,289 A * 5/1990 Artzberger ..... 404/117
5,526,590 A * 6/1996 Palm et al. ..... 37/142.5
5,873,417 A * 2/1999 Halischuk ..... 172/246
6,022,171 A * 2/2000 Munoz ..... 404/124
6,139,045 A * 10/2000 Vandenbark et al. ..... 280/638
6,435,766 B1 * 8/2002 Titford ..... 404/75
2005/0189730 A1 * 9/2005 White ..... 280/6.154

* cited by examiner

*Primary Examiner*—Raymond W Addie
(74) *Attorney, Agent, or Firm*—The Nath Law Group; Robert P. Cogan

(57) ABSTRACT

In a compaction wheel system and a method, a support frame supports system components and can be coupled to a driver. At least first and second compaction wheels are each mounted in a separate axle assembly. The axle assemblies are each mounted to the support frame on linkage assemblies which vary the distance between the compaction wheels with angular displacement. Additionally, each linkage maintains its respective compaction wheel at an angle to continue compacting operations. An adjuster may set the angular position of each linkage assembly.

11 Claims, 6 Drawing Sheets

COMPACTION WHEEL SYSTEM AND METHOD

FIELD OF THE INVENTION

The present subject matter relates to compaction systems including rotating compaction wheels.

BACKGROUND OF THE INVENTION

Compaction wheels are frequently used in conjunction with installation of various sorts of lines below grade. Lines may comprise sewer pipes, water pipes, power lines and communications lines. Trenches are cut in soil for the purpose of laying a line below grade, i.e., beneath ground level. After laying of the line is completed, the trench must be backfilled. Typically, soil piled to the sides of the trench during excavation will be pushed back into the trench with a backhoe or the like. The backfilled soil must be compacted to avoid adverse effects.

An adverse effect commonly addressed by the prior art is the resulting surface contour above the line. If the is trench is backfilled only to grade level without compacting, the soil will later settle. A depression will form along the line of the underground installation. Such a depression causes water to stand along the trench. Where the lines are communication lines, the possibility of damage to a cable at the bottom of the trench due to moisture is increased. Standing water that seeps into a trench can form ice in winter. Ice expands and causes potholes. Vehicles traveling along or across the trench can be damaged by traversing a depressed area. Where the depression crosses a footpath, people and animals may be injured if they do not see the depression. If additional soil is placed over the line to prevent later formation of a depression, a mound of soil will remain over the trench. The mound may impede travel or present an obstacle to construction over the trench.

Another important aspect of completing the backfilling process is stabilization of bedding surrounding the line. If the backfill surrounding the pipe or other line shifts due, for example, to settling, support of the line is compromised. This can lead to application of varying forces to successive segments of the line. Joint failure may ultimately result. There are several construction specifications which provide standards to assure adequate support of below grade lines. An exemplary specification is Trenching, Backfilling and Compacting (Society for Maintenance and Reliability professionals, Knoxville, Tenn. 2004). Section 3.7.1 states, "BACKFILL AT PIPE ZONE shall be placed on both sides of pipe in 4" lifts and compacted either by hand or by mechanical tamper to an elevation 1' above the pipe. Compaction shall be at least 90% of maximum dry density . . . ." Contractors face growing safety concerns over "men in the trench" regulations. Even when expensive, mandatory procedures are followed, workers in trenches still face risk of injury in trenches. Therefore, hand tamping is undesirable.

An alternative that will provide sufficient density without tamping and which meets many standard specifications is the use of a "low sack" concrete mix. One form of such a mix comprises three sacks of cement per cubic yard of sand. The cement consolidates a mixture of sand and water, providing a stable support for the line. While effective, this solution adds significant expense to a construction project.

Prior art compaction wheel units have been suited for compacting soil at grade level. An example of a trench compaction device is illustrated in U.S. Pat. No. 4,610,567. In use, the machine straddles the trench and three compaction wheels on one axle rotate to compact the soil as the machine moves. The compaction wheels are in fixed axial positions and spaced from one another. Continuous adjustment of spacing between wheels in order to provide spacing of wheels to straddle a pipe cannot be provided.

U.S. Pat. No. 5,526,590 discloses a compaction wheel which can be positioned laterally at a preselected position along the width of a driving vehicle. However, a single wheel is provided. Width of a compaction track is not adjustable.

SUMMARY OF THE INVENTION

Briefly stated, in accordance with embodiments of the present invention a compaction wheel system and a method are provided suitable for providing compaction for earth surrounding below grade lines. A support frame supports system components and can be coupled to a driver. At least first and second compaction wheels are each mounted in a separate axle assembly. The axle assemblies are each mounted to the support frame on linkages which vary the distance between the compaction wheels with angular displacement. Additionally, each linkage maintains its respective compaction wheel at an angle to continue compacting operations. An adjuster is provided to set the angular position of each linkage. Consequently the distance between the wheels is set.

In a method, earth in filled to a preselected height next to a below grade line. A compaction wheel unit is provided, and the wheels are spaced apart to straddle the line. One ore more passes of the compaction unit along a selected linear extent of the pipe may be made.

BRIEF DESCRIPTION OF THE DRAWINGS

The invention may be further understood by reference to the following description taken in connection with the following drawings.

DETAILED DESCRIPTION

Figure 1:
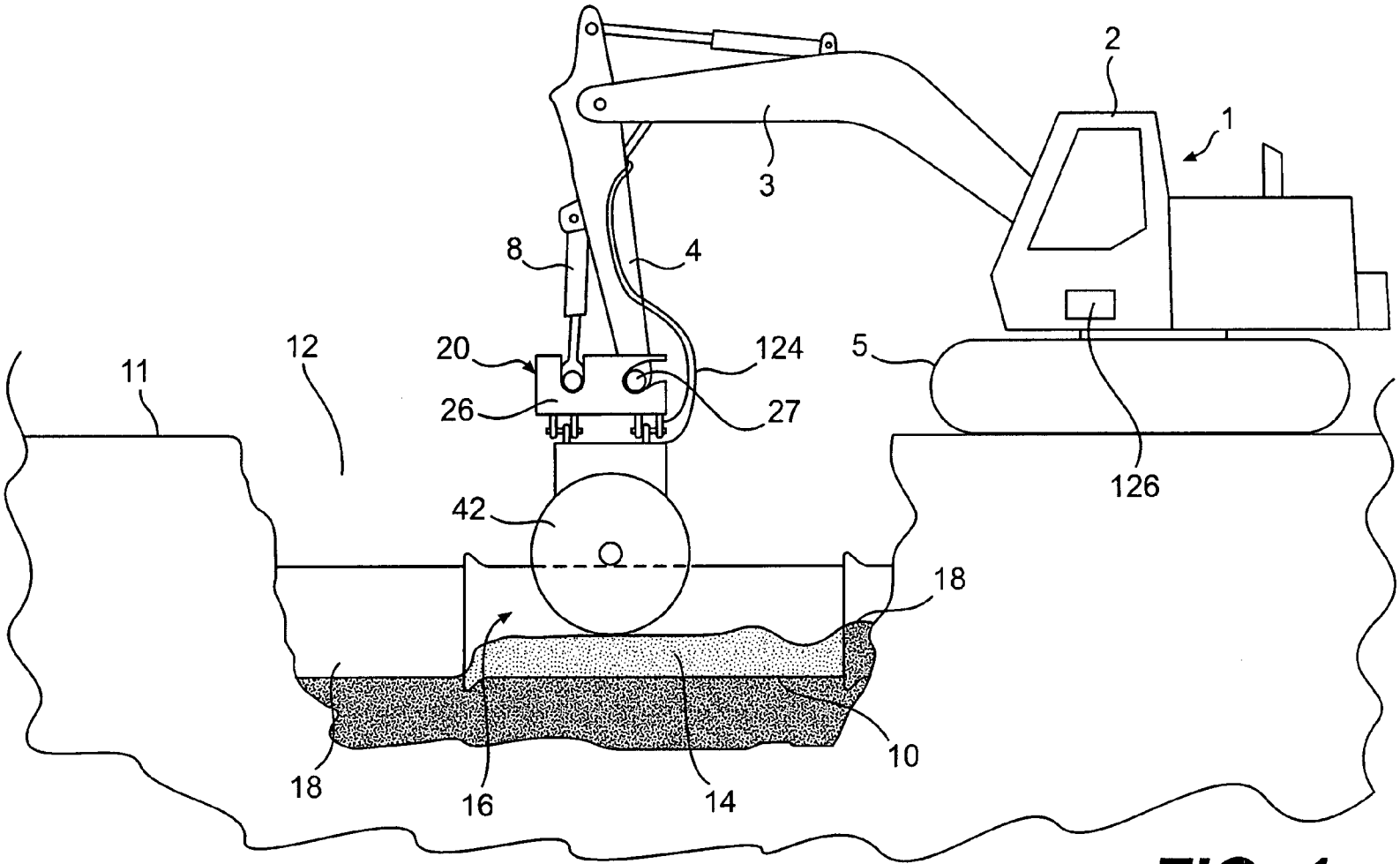
FIG. 1 is an illustration of a compaction wheel system mounted to a driver.

FIG. 1, which is partially in cross section, illustrates a driver 1 supporting a compaction wheel system 20 constructed in accordance with an embodiment of the present invention. The driver 1 is an apparatus which supports, directs and provides motive power to the compaction wheel system 20. In the present illustration, the driver 1 comprises an excavator 2. The excavator 2 has a hydraulically operated arm 3 supporting a hydraulically operated stick 4. In order to support the compaction wheel system 20, the stick 4 is raised to an elevated position projected beyond an end 5 of the excavator 2, referred to as the forward end 5. The compaction wheel system 20 is supported to the stick 4 in a manner described below. A hydraulic cylinder 8 controls pitch of the compaction wheel system 20 also as described below.

The driver 1 in the present illustration moves the compaction wheel system 20 over soil 10 in a trench 12. FIG. 1 is partially broken away to illustrate the trench 12, which is below grade level 11. In other situations, the compaction wheel system 20 could be deployed to perform compacting at grade level 11. The compaction wheel system 20 engages the soil 10 to roll along and compact a layer 14 of backfilled soil 10 along either side of a line 16. In the present embodiment, the line 16 comprises pipe segments 18. FIG. 1 is further broken away to illustrate the line 16 as embedded in the layer 14. The thickness of a layer 14 that can be compacted at one time is generally dictated by standards or job specifications.

Figure 2:
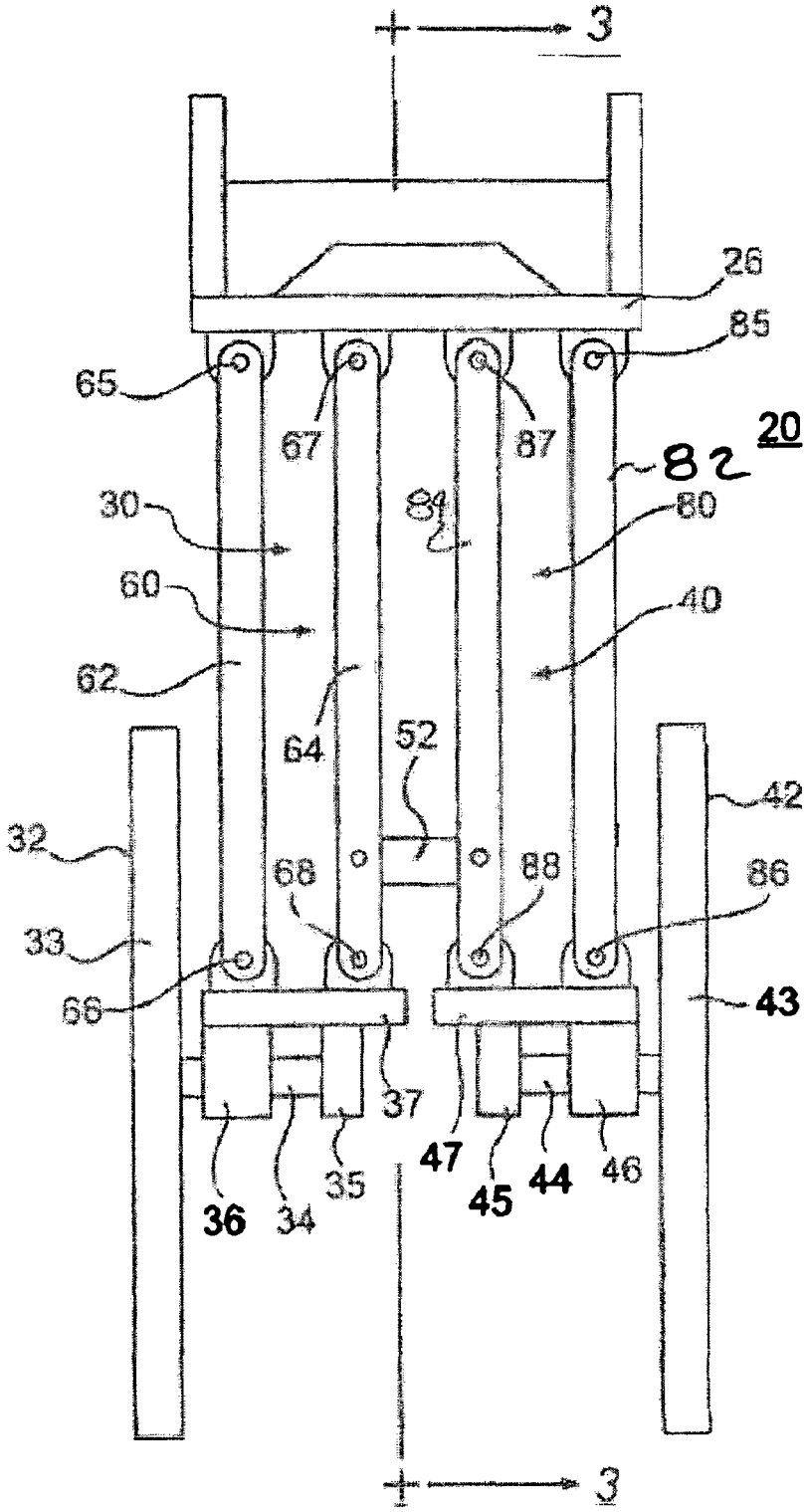
FIG. 2 is a front elevation of a compaction wheel system in a first state.
Figure 3:
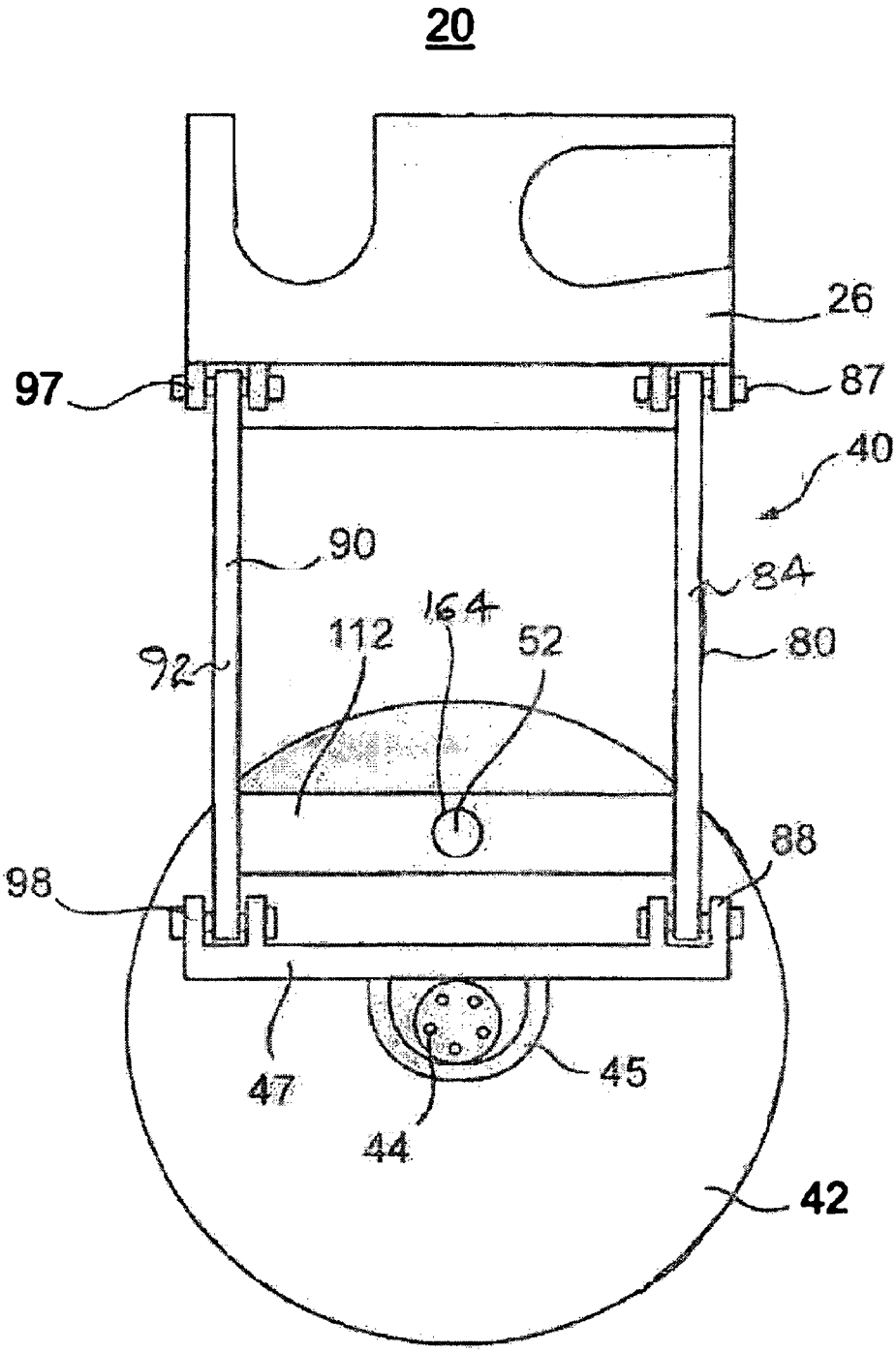
FIG. 3 a cross sectional side elevation of the compaction wheel system taken along line 3-3 of FIG. 2.

Further details are described with additional reference to FIGS. 2 and 3, which are respectively a front elevation of the compaction wheel system 20 in a first state and a cross sectional side elevation of the compaction wheel system 20 taken along line 3-3 of FIG. 2. The compaction wheel system 20 comprises a support frame 26. The support frame 26 may be releasably connected the stick 4 by a slot and pin assembly 27. The support frame 26 may pivot with respect to the slot and pin assembly 27 when the length of the hydraulic cylinder is changed. Pitch of the compaction wheel system 20 is controlled by operation of the hydraulic cylinder 8. First and second linkage assemblies 30 and 40 respectively couple first and second compaction wheels 32 and 42 to the support frame 26.

The compaction wheel 32 is constructed with dimensions useful for soil compacting. In one embodiment, the compaction wheel is solid steel with a diameter of 3 feet and a thickness of 3 inches. The compaction wheel has a compacting surface 33. Similarly, the compaction wheel 42 has a compacting surface 43. The compacting surface is the surface that is applied to the soil to be compacted, and will generally correspond to an outer diameter of the compaction wheel 32. In the illustrated embodiment, the compacting surface 33 is a flat outer diameter. However, the compaction wheels 32 and 42 could comprise sheep-foot wheels or pad-foot wheels, having circumferentially spaced, radial projections.

The compaction wheel 32 is mounted to an axle 34. In one preferred form, the axle 34 is welded to the compaction wheel 32. This construction will often be most cost-effective. However, it is possible to provide an arrangement in which the compaction wheel 32 rotates on the axle 34. The axle 34 is journaled in mounting brackets 35 and 36 of an axle support platform 37. The axle support platform 37 is pivotally supported to the linkage assembly 30 as further described below. Similarly, the compaction wheel 42 is journaled in mounting brackets 45 and 46 of an axle support platform 47. Each axle support platform 37 or 47 supports a corresponding compaction wheel in a compacting orientation. A compacting orientation is one in which the compacting wheel 32 or 42 will rotate and in which the compacting surface 33 or 43 engages the soil 10. The compaction wheel system 20 permits convenient adjustment of the distance between the compaction wheels 32 and 42 while maintaining them each in a compacting orientation.

In one preferred form, when the linkage assemblies 30 and 40 are vertically disposed, the compaction wheels 32 and 42 are in a first position, which is their closest spacing. The linkage assemblies 30 and 40 are operated by a displacement adjuster 52 to select a distance to be maintained between the first and second compaction wheels 32 and 42 and maintain the first and second compaction wheels 32 and 42 in a compacting orientation.

Figure 4:
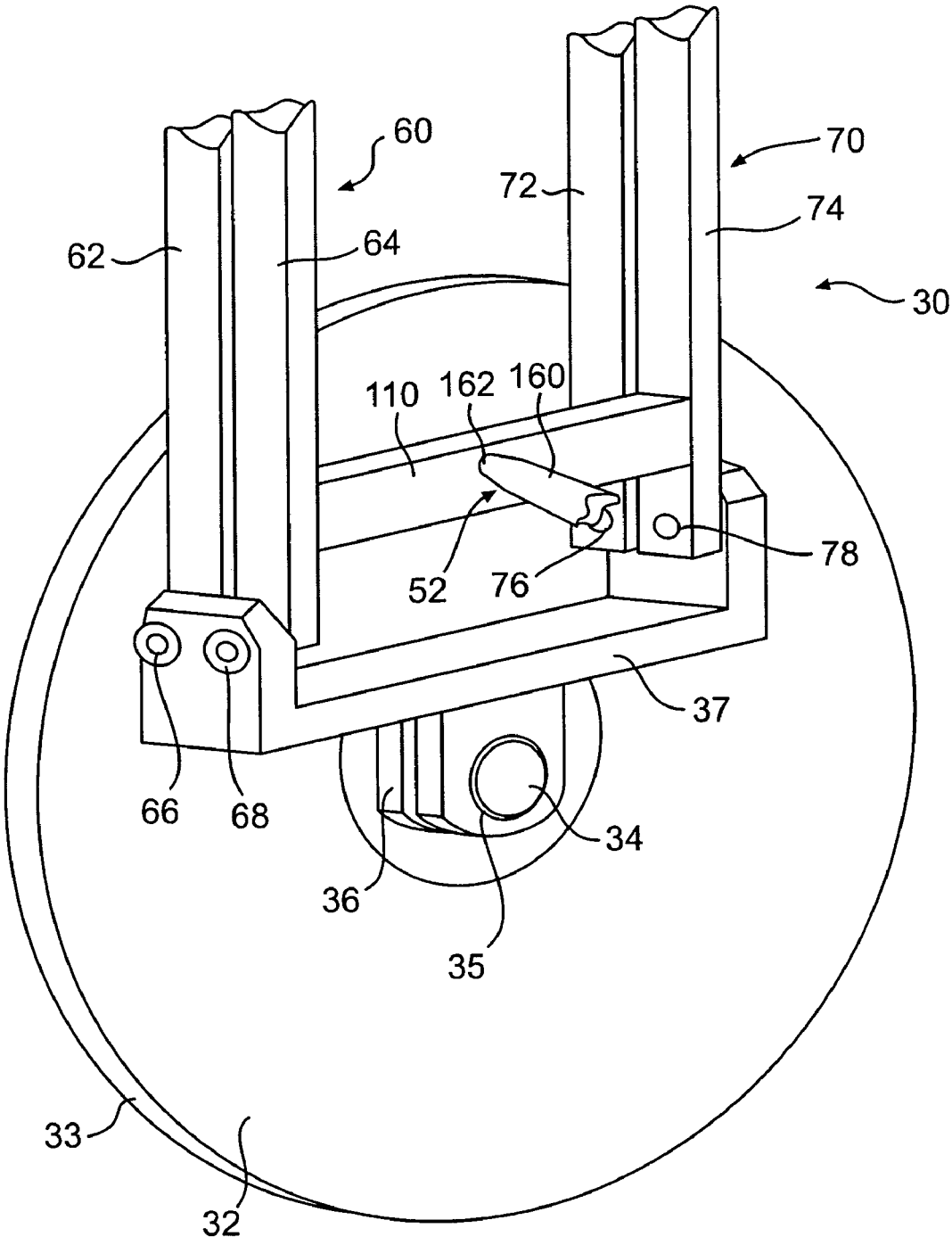
FIG. 4 is an axonometric partial detailed view of a compaction wheel and axle mounting.
Figure 5:
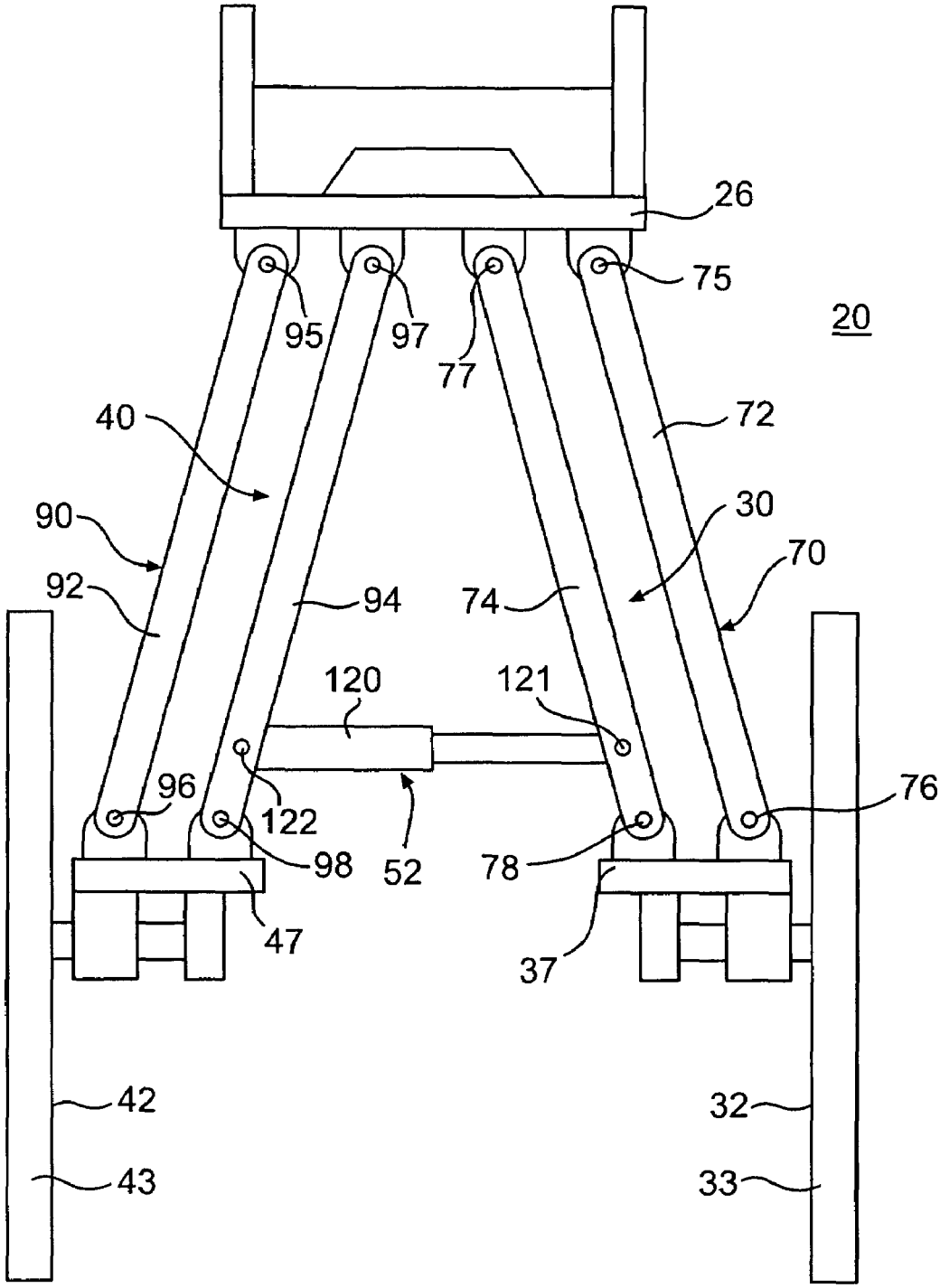
FIG. 5 is a rear elevation of a compaction wheel system in a second state.

The structure of the linkage assemblies 30 and 40 and cooperating structures are described with respect to FIG. 4, which is an axonometric partial detailed view of a compaction wheel and axle mounting, and with respect to FIG. 5, which is a rear elevation of a compaction wheel system 20, as well as with respect to FIGS. 2 and 3. In FIG. 5, the compaction wheel system 20 is in a second state in which the compaction wheels 32 and 42 are not at their closest relative position. The linkage assembly 30 comprises a forward linkage 60 and a rear linkage 70. Each of the linkages 60 and 70 comprises a parallelogram linkage. The forward linkage 60 comprises first and second arms 62 and 64. The arm 62 is pivoted at upper and lower pivot joints 65 and 66 to the support frame 26 and the support platform 37 respectively. The arm 64 is pivoted at upper and lower pivot joints 67 and 68 to the support frame 26 and the support platform 37 respectively. Similarly, the rear linkage 70 comprises first and second arms 72 and 74. The arm 72 is pivoted at upper and lower pivot joints 75 and 76 to the support frame 26 and the support platform 37 respectively. The arm 74 is pivoted at upper and lower pivot joints 77 and 78 to the support frame 26 and the support platform 37 respectively.

In a like manner, the linkage assembly 40 comprises a forward linkage 80 and a rear linkage 90. Each of the linkages 80 and 90 comprises a parallelogram linkage. The forward linkage 80 comprises first and second arms 82 and 84. The arm 82 is pivoted at upper and lower pivot joints 85 and 86 to the support frame 26 and the support platform 47 respectively. The arm 84 is pivoted at upper and lower pivot joints 87 and 88 to the support frame 26 and the support platform 47 respectively. Similarly, the rear linkage 90 comprises first and second arms 92 and 94. The arm 92 is pivoted at upper and lower pivot joints 95 and 96 to the support frame 26 and the support platform 47 respectively. The arm 94 is pivoted at upper and lower pivot joints 97 and 98 to the support frame 26 and the support platform 47 respectively.

Within the linkage assembly 30, the linkages 60 and 70 are joined by a bar 110. Within the linkage assembly 40, the linkages 80 and 90 are joined by a bar 112. Opposite ends of the displacement adjuster 52 are coupled to the bars 110 and 112. The displacement adjuster 52 in one preferred form may comprise a hydraulic actuator 120. Another form of displacement adjuster is further described below with respect to FIG. 4. The hydraulic actuator 120 is pivotally coupled at opposite ends thereof to the linkage arms 74 and 94 by pivot couplings 121 and 122 respectively. A hydraulic line 124 (FIG. 1) coupled to a hydraulic control unit 126 on the excavator 2 is connected to power the hydraulic actuator 120. In a first position the hydraulic actuator 120 is at its minimum length, and in the illustrated embodiment, the linkage assemblies 30 and 40 in vertical positions. When the hydraulic control circuit 126 is operated, a piston within the hydraulic actuator 120 is displaced to a selected position, called a second position of the hydraulic actuator 120, to lengthen the hydraulic actuator 120. The linkage assemblies 30 and 40 each rotate with respect to the support frame 26. Consequently, the compaction wheels 32 and 42 swing away from each other. The A selected distance between the compaction wheels 32 and 42 is provided by moving the hydraulic actuator 126 to the second position.

As the linkages 30 and 40 move angularly, the vertical distance from the compaction wheels 32 and 42 to the support frame 26 decreses. The position of the stick 4 of the excavator 2 (FIG.1) can be changed to assure that the compaction wheel system 20 is in proper engagement with the soil 10. The parallelogram linkages 60 and 70 comprimising the linkage assembly 30 and the parallelogram linkages 80 and 90 comprimising the linkage assembly 40 maintain the compaction wheels 32 and 42 in the compacting orientation as the position of the hydraulic actuator 120 changes.

The hydraulic actuator 120 is self-adjusting to provide equal and simultaneous angular displacement of the linkage assemblies 30 and 40. As the hydraulic actuator 120 lengthens, the linkage assemblies 30 and 40 are angulary displaced. A relative displacement between the first and second compaction wheels 32 and 42 to define a second position is selected. The first and second compaction wheels 32 and 42 are maintained in the second position. The compaction wheel 32 rotates about the pivot points in the linkages 60 and 70, while the compaction wheel 42 rotates about the pivot points in the linkages 80 and 90. The compaction wheels 32 and 42 are maintained in the compaction orientation.

In the embodiment of FIG. 4, the displacement adjuster 52 comprises a fixed length rod 160 which may have ends received in recesses 162 and 164 (FIG. 3) in the bars 110 and 112 respectively. The ends of the rod 160 and the apertures 162 and 164 may include conventional interlocking components.

Figure 6:
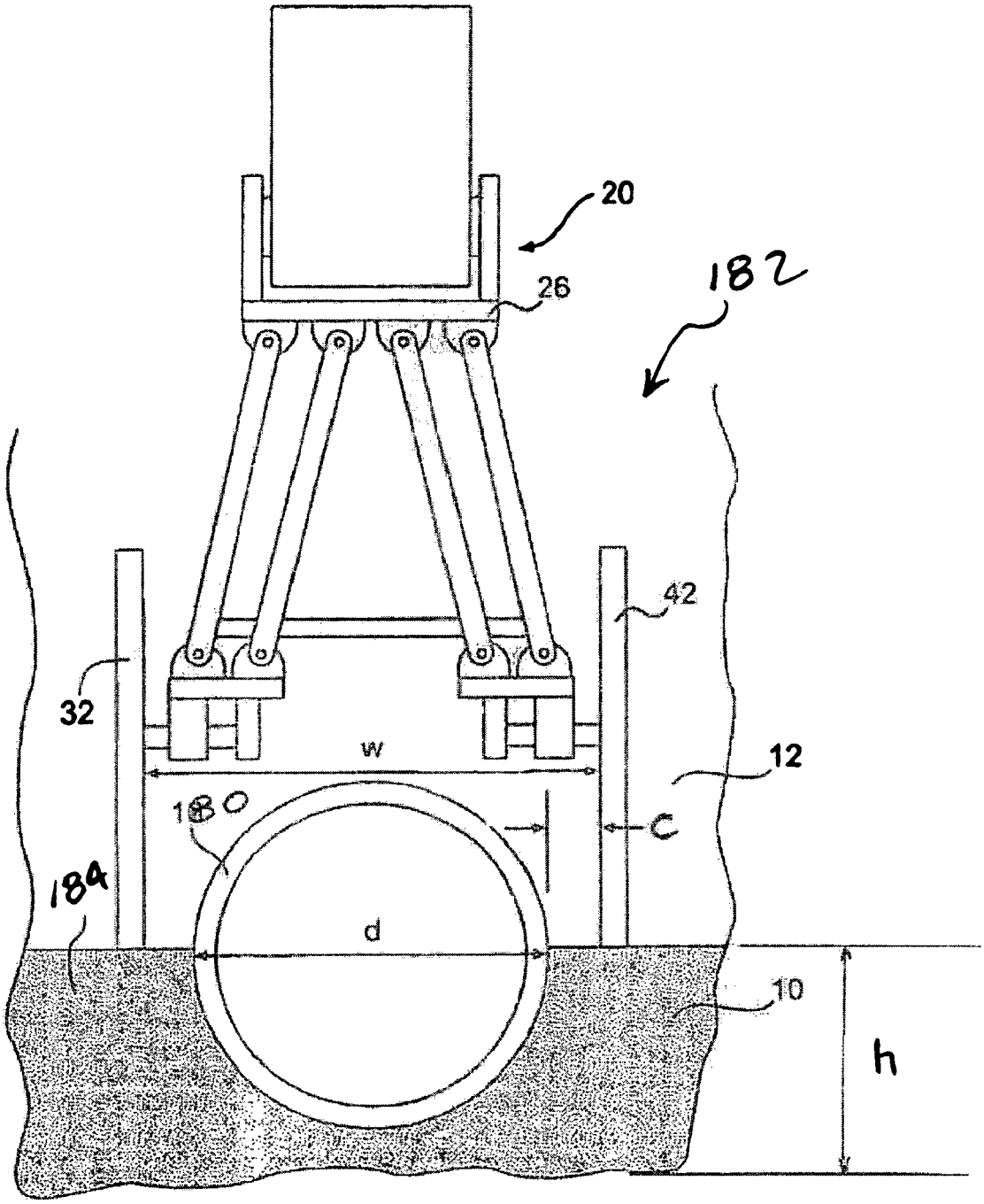
FIG. 6 is an illustration of a compaction operation.

FIG. 6 is an illustration of a compaction operation. A compaction wheel system 20 is used to compact backfill surrounding sides of a pipe 180. The pipe 180 is in a trench 182 and being supported in backfill 184. The displacement adjuster 52 is set to provide a distance w between the first and second compaction wheels 32 and 42 to straddle the pipe 180. The distance w=d+2c, where d is the outer diameter of the pipe 180 and c is the requisite clearance between a compaction wheel 32 or 42 and the pipe 180. The value of c may be selected as a matter of choice of a system operator or may be dictated by a standard or specification. Also, when the bottoms of the compaction wheels 32 and 42 are at least at the height of the center of the pipe 180, w may be less than d+2c. An incremental depth h of backfill 184 is added in the trench 182. The value of h may be dictated by standards.

The compaction wheel system 20 is lowered in the trench 182 to the surface of the backfill 184. The excavator 2 (FIG. 1) allows substantially the entire weight of the compaction wheel system 20 to rest on the back fill 184. The excavator 2 is then moved to drag the compaction wheel system 20 along a preselected linear extent of the pipe 120. Under certain conditions, depending, for example, on factors such as composition and moisture content of the backfill 184, compaction to applicable standards may be provided in a single pass. Compaction over a limited linear extent may also be performed while the excavator 2 is stationary. An operator may move the stick 4 back and forth, i.e. rotate the stick 4 about its pivot with the arm 3. At the same time, the operator adjusts the pitch of the compaction wheel system 20 by adjusting the length of the hydraulic cylinder 8. In many foreseeable situations, sufficient compaction may be achieved in no more than three passes.

Embodiments of the present invention provide for a compaction wheel system with continuously adjustable width of a compacting path and a method for selection of a width of the compacting path. The present subject matter being thus described, it will be apparent that the same may be modified or varied in many ways. Such modifications and variations are not to be regarded as a departure from the spirit and scope of the present subject matter, and all such modifications are intended to be included within the scope of the following claims.

What is claimed is:

1. A trench compaction system comprising: a support frame to couple said system to a driver, a first compaction wheel and a first wheel support having said first compaction wheel mounted therein for rotation; a second compaction wheel and a second wheel support having said second compaction wheel mounted therein for rotation; a first linkage assembly pivotally coupling said first wheel support to said support frame; and a second linkage assembly pivotally coupling said second wheel support to said support frame, said first and second linkages maintaining each of said first and second compaction wheels in a compacting orientation and varying the distance between said first and second compaction wheels as a function of angular displacement of each of said first and second linkages; and a displacement adjuster having opposite ends coupled to said first and second linkages respectively.

2. A trench compaction system according to claim 1, wherein said displacement adjuster is connected between said first and second linkages to determine lateral displacement between corresponding points on said first and second linkages.

3. A trench compaction system according to claim 2, wherein said displacement adjuster comprises a variable length hydraulic cylinder.

4. A trench compaction system comprising: a support frame to couple said system to a driver, a first compaction wheel and a first wheel support having said first compaction wheel mounted therein for rotation; a second compaction wheel and a second wheel support having said second compaction wheel mounted therein for rotation; a first linkage assembly pivotally coupling said first wheel support to said support frame; and a second linkage assembly pivotally coupling said second wheel support to said support frame, said first and second linkages maintaining each of said first and second compaction wheels in a compacting orientation and varying the distance between said first and second compaction wheels as a function of angular displacement of each of said first and second linkages; a displacement adjuster comprising a variable length hydraulic cylinder connected between said first and second linkages to determine lateral displacement between corresponding points on said first and second linkages, wherein said hydraulic cylinder is pivotally connected to said first and second linkage assemblies at opposite ends thereof and has a first, minimum length corresponding to vertical disposition of said first and second linkage assemblies.

5. A trench compaction system according to claim 2, wherein each said wheel support comprises a support platform and wherein each said wheel support comprises an axle retained in said support platform having fist and second longitudinal ends.

6. A trench compaction system according to claim 5, wherein each said axle is fixed to one said compaction wheel and wherein each axle is journaled in one said support platform.

7. A trench compaction system according to claim 5, wherein each said support platform has a forward and rear end wherein each said linkage assembly comprises first and second parallelogram linkages adjacent said forward and rear ends respectively.

8. A trench compaction system according to claim 7 wherein said displacement adjuster comprises a fixed length member.

9. A method for operating a compaction wheel system to compact backfill around a below grade line comprising: providing a compaction wheel system including first and second compaction wheel assemblies each pivotally suspended from a support frame in a first position; a adjusting relative displacement between said first and second compaction wheels with a displacement adjuster having first and second ends coupled to said first and second compaction wheels respectively to define a second position on which said compaction wheel assemblies are positioned to straddle the line; maintaining said first and second compaction wheels in said selected relative displacement; placing said compaction wheel system over the line; and moving said compaction wheel system along a preselected linear extent of the line.

10. A method according to claim 9, wherein said relative displacement is determined by rotating each said compaction wheel assembly an equal amount with respect to said support frame.

11. A method according to claim 10, wherein selecting said relative displacement comprises moving said first and second compaction wheel assemblies simultaneously.

* * * * *